US010050331B2

(12) United States Patent
Zhou et al.

(10) Patent No.: US 10,050,331 B2
(45) Date of Patent: Aug. 14, 2018

(54) ANTENNA STRUCTURE FOR MOBILE PHONE

(71) Applicant: Luxshare Precision Industry Co., Ltd., Shenzhen, Guangdong Province (CN)

(72) Inventors: Chun-Long Zhou, Kunshan (CN); Fang-Fang Zhang, Kunshan (CN)

(73) Assignee: LUXSHARE PRECISION INDUSTRY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/201,627

(22) Filed: Jul. 5, 2016

(65) Prior Publication Data

US 2017/0012348 A1 Jan. 12, 2017

(30) Foreign Application Priority Data

Jul. 6, 2015 (CN) ..... 2015 1 0388105

(51) Int. Cl.
*H01Q 1/24* (2006.01)
*H01Q 1/48* (2006.01)
*H01Q 9/04* (2006.01)

(52) U.S. Cl.
CPC ..... *H01Q 1/243* (2013.01); *H01Q 1/48* (2013.01); *H01Q 9/0421* (2013.01)

(58) Field of Classification Search
CPC ..... H01Q 1/243; H01Q 9/0421
See application file for complete search history.

(56) References Cited

U.S. PATENT DOCUMENTS

2006/0197705 A1* 9/2006 Chen ..... H01Q 1/243 343/700 MS
2013/0194143 A1* 8/2013 Bungo ..... H01Q 21/28 343/725
2014/0184449 A1* 7/2014 Dong ..... H01Q 13/106 343/702
2014/0306848 A1* 10/2014 Hong ..... H01Q 1/243 343/702
2014/0333488 A1* 11/2014 Wang ..... H01Q 1/243 343/702

* cited by examiner

*Primary Examiner* — Daniel J Munoz
(74) *Attorney, Agent, or Firm* — Cheng-Ju Chiang

(57) ABSTRACT

An antenna structure for mobile phone includes a branch antenna acting with a metal shell of the mobile phone, an insulating body located in the metal shell, a main antenna disposed on the insulating body to be coupled to the metal shell and having a feed portion, and a feed-line including a conductive portion welded with the feed portion. The metal shell has a back cover and a ring-shaped metal frame integrated with the back cover. A circuit board is located in the metal shell. The main antenna has a ground portion connected to a ground circuit of the circuit board, and the feed-line includes a braid portion connected with the ground circuit. The metal frame is formed into a continuous metallic loop configuration to ensure integrality and beauty of the metal shell for the mobile phone.

7 Claims, 3 Drawing Sheets

ANTENNA STRUCTURE FOR MOBILE PHONE

CROSS-REFERENCE TO RELATED APPLICATIONS

This application claims priority to Chinese Patent Application No. 201510388105.3, filed on Jul. 6, 2015, the entire content of which is incorporated herein by reference.

BACKGROUND OF THE INVENTION

1. Field of the Invention

The present invention generally relates to wireless communication technology, and more particularly to an antenna structure for a mobile phone.

2. The Related Art

During product development processes of conventional communication devices, such as mobile phones, plastic shells are mainly used by manufacturers due to cost concerns, in order to maintain basic radiation characteristics of an antenna structure. But currently, a trend of metal shell is brought by Apple iPhones. Since the metal shell has light weight, good heat dissipation, high strength, high impact resistance, good looking and recyclable characteristics, the metal shell becomes more and more popular.

However, the metal shell usually generates shield which reduces efficiency of the antenna structure. For solving the problem, the metal shell is often opened with slits in positions corresponding to the antenna structure. But the slits may obviously ruin appearance of the metal shell.

Therefore, it is important to design a proper antenna structure capable of achieving a metal shell formed into a continuous metallic loop configuration for a mobile phone.

SUMMARY OF THE INVENTION

An object of the present invention is to provide an antenna structure for mobile phone. The antenna structure includes an insulating body, a main antenna disposed on the insulating body and having a feed portion and a ground portion, a branch antenna acting with a metal shell of the mobile phone, and a feed-line. The metal shell has a back cover and a ring-shaped metal frame surrounding the back cover along a periphery edge and integrated with the back cover. A receiving space is formed between the back cover and the metal frame. The insulating body and the main antenna are located in the receiving space. The main antenna is coupled to the metal shell to make the metal shell act as the branch antenna. The ground portion of the main antenna is connected to a ground circuit of the circuit board. The feed-line includes a conductive portion welded with the feed portion of the main antenna, and a braid portion connected with the ground circuit of the circuit board.

As described above, the antenna structure of the present invention utilizes the metal frame of the metal shell as the branch antenna thereof, and the metal frame is formed into a continuous metallic loop configuration, to ensure integrality and beauty of the metal shell for the mobile phone, and further improve the low frequency performance of the antenna structure for the mobile phone.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
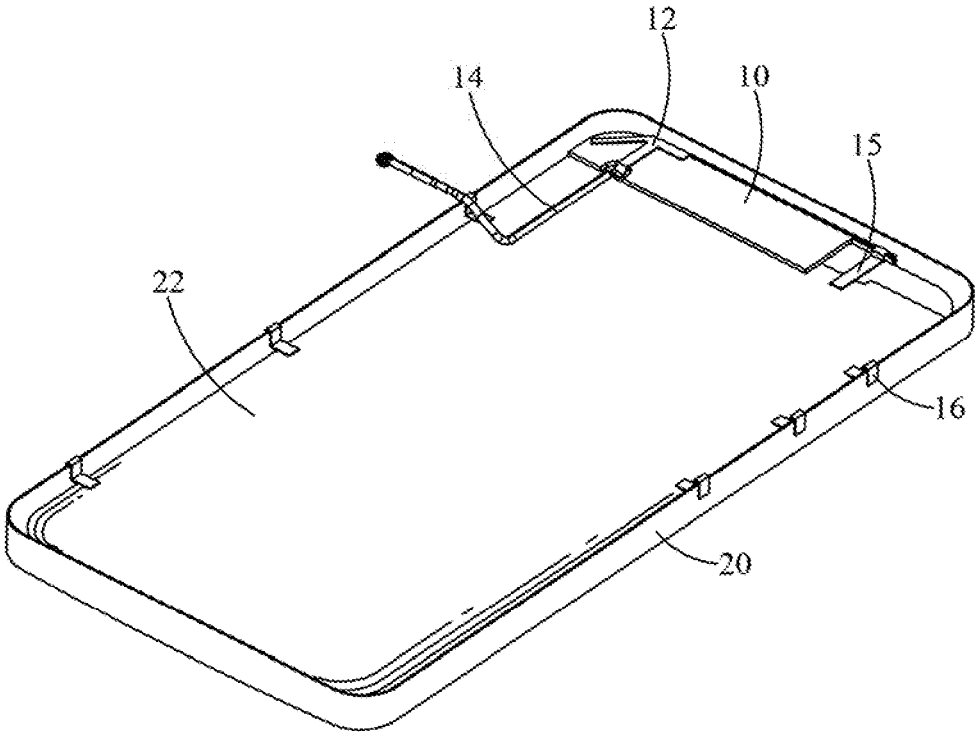
FIG. 1 is an assembled perspective view of an antenna structure for mobile phone in accordance with an embodiment of the present invention.
Figure 2:
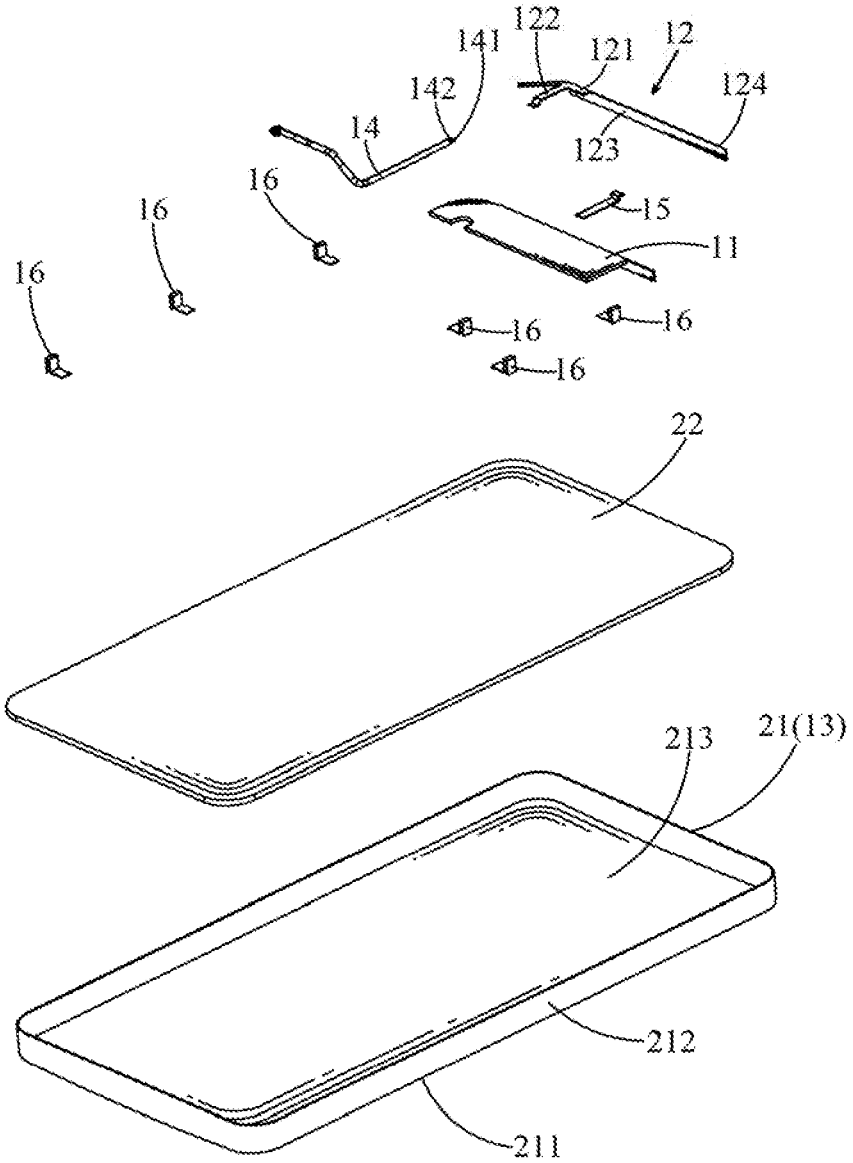
FIG. 2 is an exploded perspective view of the antenna structure for mobile phone of FIG. 1.
Figure 3:
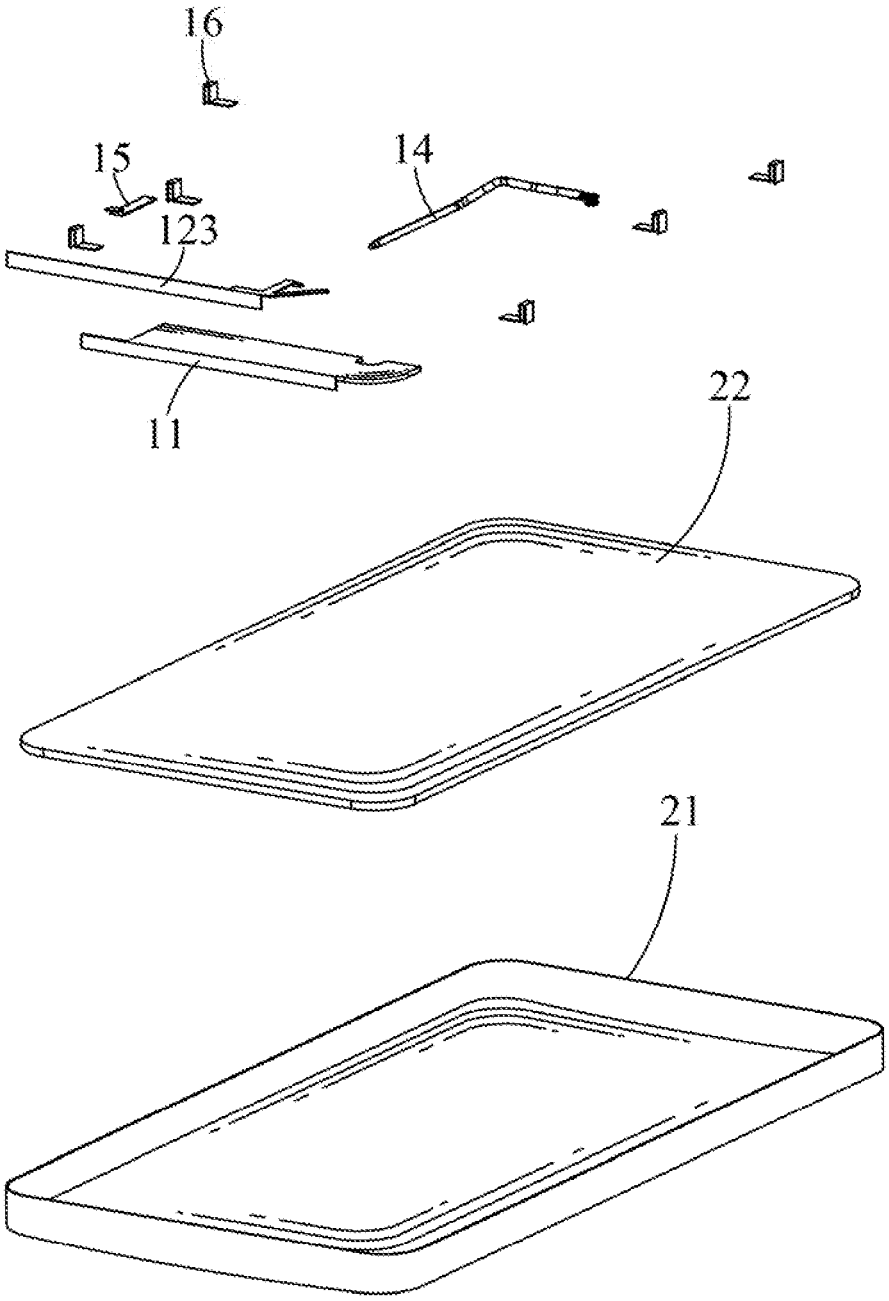
FIG. 3 is another exploded perspective view of the antenna structure for mobile phone of FIG. 1.

With reference to FIGS. 1-3, an antenna structure 10 for a mobile phone 20 according to an embodiment of the present invention includes an insulating body 11, a main antenna 12, a branch antenna 13 and a feed-line 14.

The main antenna 12 is disposed on the insulating body 11. The main antenna 12 has a horizontal base strip 121, a feed portion 122 extending inwardly from an inner edge of the base strip, and a coupling strip 123 extending vertically from an outer edge of the base strip. One end of the coupling strip 123 is defined as a ground portion 124.

A metal shell 21 of the mobile phone 20 is performed as the branch antenna 13. The metal shell 21 has a back cover 211 and a ring-shaped metal frame 212 surrounding the back cover 211 along a periphery edge and integrated with the back cover 211 into one piece. A receiving space 213 is formed between the back cover 211 and the metal frame 212.

A circuit board 22, together with the insulating body 11 and the main antenna 12 are located in the receiving space 213 of the metal shell 21. The main antenna 12 is apart from the metal shell 21 and coupled to the metal shell 21 to make the metal shell 21 act as the branch antenna 13, in detail, the coupling strip 123 of the main antenna 12 is apart from and faces to an inside face of the metal frame 212 and is coupled to the metal frame 212. The ground portion 124 of the main antenna 12 is connected to a ground circuit (not shown) of the circuit board 22.

The feed-line 14 includes a conductive portion 141 and a braid portion 142. The conductive portion 141 is welded with the feed portion 122 of the main antenna 12, and the braid portion 141 is connected with the ground circuit of the circuit board 22.

Furthermore, in this embodiment, the ground portion 124 of the main antenna 12 is connected to the ground circuit of the circuit board 22 via a connecting component 15. In detail, one end of the connecting component 15 is connected with the ground circuit of the circuit board 22 and the other end of the connecting component 15 is electrically lapped over the ground portion 124 of the main antenna 12.

Referring to FIG. 1 and FIG. 2 again, the antenna structure 10 further includes a plurality of shorting components 16 which are connected between the metal frame 212 of the metal shell 21 and the ground circuit of the circuit board 22 at intervals. In detail, the metal frame 212 contacts, or is welded with, or is integrated with each of the shorting components 16. The positions of the shorting components 16 relative to the metal frame 212 and the circuit board 22 can be adjusted in accordance with different frequency bands of the antenna structure 10.

As described above, the antenna structure 10 of the present invention utilizes the metal frame 212 of the metal shell 21 as the branch antenna 13 thereof, and the metal frame 212 is formed into a continuous metallic loop configuration, to ensure integrality and beauty of the metal shell 21 for the mobile phone 20, and further improve the low frequency performance of the antenna structure 10 for the mobile phone 20.

It is understood that the invention may be embodied in other forms within the scope of the claims. Thus the present examples and embodiments are to be considered in all respects as illustrative, and not restrictive, of the invention defined by the claims.

What is claimed is:

1. An antenna structure, for a mobile phone, comprising: an insulating body;

a main antenna disposed on the insulating body, the main antenna having a feed portion and a ground portion connected to a ground circuit of the circuit board;

a metal shell of the mobile phone coupled to the main antenna to perform as a branch antenna, the metal shell having a back cover, a continuous ring-shaped metal frame surrounding the back cover along a periphery edge and integrated with the back cover, and a receiving space formed between the back cover and the metal frame for receiving the insulating body and the main antenna; and a feed-line including a conductive portion and a braid portion, the conductive portion being welded with the feed portion of the main antenna, the braid portion being connected with the ground circuit of the circuit board;

wherein the main antenna has a horizontal base strip, an outer edge of the base strip vertically extends to form a coupling strip apart from and facing to an inside face of the metal frame and coupled to the metal frame, one end of the coupling strip is defined as the ground portion, and an inner edge of the base strip extends inwardly to form the feed portion.

2. The antenna structure for a mobile phone as claimed in claim 1, wherein the ground portion of the main antenna is connected to the ground circuit of the circuit board via a connecting component.

3. The antenna structure for a mobile phone as claimed in claim 2, wherein one end of the connecting component is connected with the ground circuit of the circuit board, and the other end of the connecting component is electrically lapped over the ground portion of the main antenna.

4. The antenna structure for a mobile phone as claimed in claim 1, further comprising a plurality of shorting components which are connected between the metal frame and the ground circuit of the circuit board at intervals.

5. The antenna structure for a mobile phone as claimed in claim 4, wherein each of the shorting components contacts with the metal frame.

6. The antenna structure for a mobile phone as claimed in claim 4, wherein each of the shorting components is welded with the metal frame.

7. The antenna structure for a mobile phone as claimed in claim 4, wherein each of the shorting components is integrated with the metal frame.

* * * * *